US011174091B2

(12) United States Patent
Bissen et al.

(10) Patent No.: US 11,174,091 B2
(45) Date of Patent: Nov. 16, 2021

(54) LIGHTWEIGHT INSULATING BOTTLE

(71) Applicant: RIPRUP Company S.A., St. Peter Port (GG)

(72) Inventors: Monique Bissen, Pforzheim (DE); Josef Schucker, Ronco Sopra Ascona (CH)

(73) Assignee: RIPRUP Company S.A., St. Peter Port (GG)

( * ) Notice: Subject to any disclaimer, the term of this patent is extended or adjusted under 35 U.S.C. 154(b) by 138 days.

(21) Appl. No.: 16/503,853

(22) Filed: Jul. 5, 2019

(65) Prior Publication Data

US 2020/0024060 A1 Jan. 23, 2020

(30) Foreign Application Priority Data

Jul. 23, 2018 (EP) ..... 18185015
Jul. 25, 2018 (EP) ..... 18185492
Jun. 26, 2019 (EP) ..... 19151385

(51) Int. Cl.
*B65D 81/38* (2006.01)
*B65D 43/02* (2006.01)

(52) U.S. Cl.
CPC ..... *B65D 81/3846* (2013.01); *B65D 43/0231* (2013.01); *B65D 2543/00092* (2013.01);
(Continued)

(58) Field of Classification Search
CPC ..... F17C 13/006; F17C 2201/0109; F17C 2203/0604; F17C 2203/0646;
(Continued)

(56) References Cited

U.S. PATENT DOCUMENTS 3,921,844 A * 11/1975 Walles ..... B32B 15/08 215/13.1
4,138,027 A 2/1979 Frye et al.
(Continued)

FOREIGN PATENT DOCUMENTS

| | | |
|---|---|---|
| EP | 3 187 621 A1 | 7/2017 |
| GB | 2 129 117 A | 5/1984 |
| JP | 2-261415 | 10/1990 |

OTHER PUBLICATIONS

European Patent Office: "European Search Report"; dated Feb. 12, 2020; EP Application No. EP 19 18 2648.

*Primary Examiner* — Shawn M Braden
(74) *Attorney, Agent, or Firm* — Bryan W. Bockhop; Bockhop Intellectual Property, LLC

(57) ABSTRACT

A beverage vessel for storing beverage includes an inner flask made of metal forming a base material, wherein in the inner flask is adapted to store the beverage, an outer flask, a thermally insulating layer arranged between the inner flask and the outer flask and an opening for pouring the beverage into the beverage vessel or pouring the beverage out of the beverage vessel, wherein the base material of the inner flask is coated in its interior surface with an inert metal coating. The invention also discloses a beverage vessel lid, comprising locking means adapted to engage with complimentary locking means of a beverage vessel for releasably locking the lid to the beverage vessel, a sealing adapted to engage with a sealing surface of the beverage vessel, wherein at least the portion of the lid surrounded by the sealing is covered by an inert metal coating.

19 Claims, 2 Drawing Sheets

(52) U.S. Cl.
CPC ..... *B65D 2543/00277* (2013.01); *B65D 2543/00314* (2013.01); *B65D 2543/00527* (2013.01); *B65D 2543/00537* (2013.01)

(58) Field of Classification Search
CPC ..... F17C 2203/0648; F17C 2203/0663; F17C 2209/2163; F17C 2209/2181; F17C 2223/0161; F17C 2203/0607; F17C 25/14; F17C 23/02; F17C 11/16; B65D 11/16; B65D 23/02; B65D 2543/00314; B65D 25/14; B65D 43/0231
See application file for complete search history.

(56) References Cited

U.S. PATENT DOCUMENTS

| | | | | |
|---|---|---|---|---|
| 5,038,948 | A * | 8/1991 | Signorini | A61J 11/045 215/11.1 |
| 2014/0251859 | A1* | 9/2014 | Weikart | A61L 31/16 206/524.9 |
| 2016/0318693 | A1* | 11/2016 | Hein | B65D 51/242 |
| 2017/0002227 | A1* | 1/2017 | Gibanel | C09D 5/022 |
| 2018/0036202 | A1* | 2/2018 | Wengreen | B65D 81/18 |
| 2018/0078093 | A1 | 3/2018 | Petrillo et al. | |
| 2018/0105346 | A1 | 4/2018 | Tolman et al. | |
| 2018/0116433 | A1* | 5/2018 | Smaldone | B65D 81/3869 |

* cited by examiner

LIGHTWEIGHT INSULATING BOTTLE

This application claims the benefit of: European Patent Application No. EP18185015.7, filed 23 Jul. 2018; European Patent Application No. EP18185492.8, filed 25 Jul. 2018; and European Patent Application No. EP19182648.6, filed 26 Jun. 2019, the entirety of each of which is hereby incorporated herein by reference.

BACKGROUND OF THE INVENTION

1. Field of the Invention

The present invention relates to a lightweight insulating beverage vessel.

2. Description of the Related Art

E thermos jugs are known. Generally, thermos jugs have an inner flask made of glass and an outer flask made of plastics. Such thermos jugs are sensitive to shocks, since the interior flask may be destroyed, if the thermos chucks falls on a floor. Further, the optical appearance of the outer flask made of plastics is not appealing to all users. Prior art thermos jugs have a undesired high weight.

It is also known to manufacture the interior flask and the outer flask of metal, such as steel. However, tests showed that steel particles will migrate into the beverage. This is undesired from a health perspective and deteriorates taste. Metallic smell is undesired by many users.

SUMMARY OF THE INVENTION

It is an object of the present invention to provide an improved lightweight beverage vessel, particularly a portable beverage bottle.

The object of the present invention is solved by a beverage vessel according to claim 1 and a lid according to claim 15.

The invention discloses a beverage bottle for storing beverage having an inner flask and an outer flask and a thermally insulating layer. The inner flask is made of metal forming a base material. The inner flask is adapted to store beverage. The base material of the inner flask may be non-inert metal. The thermally insulating layer is arranged between the inner flask and the outer flask. The beverage vessel comprises an opening for pouring beverage into the beverage vessel or pouring beverage out of the beverage vessel, particularly for pouring the beverage into the inner flask or out of the inner flask. The inner flask is coated in its interior surface with an inert metal coating.

The invention also discloses a beverage vessel lid comprising locking means adapted to engage with complementary looking means of a beverage vessel for releasably locking the lid to the beverage vessel. The beverage vessel lid further comprises a sealing adapted to engage with a sealing surface of the beverage vessel. At least the portion of the lid surrounded by the sealing is covered by an inert metal coating. The locking means and the complementary locking means may be an inner thread and an outer thread, respectively engaging in each other. The lid may be made of metal, such as steel.

The invention also discloses a beverage vessel comprising the lid.

The inert coating prevents that the beverage can diffuse to the metal of the base material of the inner flask or lid and/or that molecules of the inner flask may diffuse into the beverage. Further, the inert metal coating prevents oxidation of the inner flask and the lid. The inert metal coating also prevents that oxides formed in the base material of the inner flask or the lid are entering the beverage. The inert metal coating prevents metallic smell in the vessel or metallic taste of the beverage.

The inert metal coating may have a thickness that prevents metal of the base material of the inner flask or metal of the lid to enter beverage. The inert metal coating is at least on 95% of its surface non-prose, preferably approximately 99% of the surface non-prose, more preferred approximately 99.9% of its surface non-prose. Thereby, a thin layer of inert metal coating is provided that effectively prevents metal or other molecules of the base material of the inner flask or lid to enter the beverage. The thickness of the inert metal coating may be selected such that the surface of the inert metal coating comprises a pore density of less than 100 pores per $cm^2$, preferably less than 50 pores per $cm^2$, more preferred less than 10 pores per $cm^2$, most preferred less than 5 pores per $cm^2$.

The inert metal coating may comprise gold, platinum, palladium, ruthenium, silver and/or titanium.

The inert metal coating may comprise an alloy comprising gold, platinum, palladium, ruthenium, silver and/or titanium. In a preferred embodiment the alloy may comprise hard gold. This gold layer comprises alloy constituents of cobalt and/or copper in order to increase the hardness of the layer. Hard gold is is more resistant to abrasion and scratches than fine gold with a hardness of 40-120 HV (HV: Hardness according to Vickers). The hardness of the inertial metal coating and/or hard gold layer may range between approximately 150 HV to 250 HV, preferably between approximately 120 HV to approximately 360 HV. The hard gold alloy has the advantage that there is not abrasion during use and it can be manufactured by acceptable efforts.

The inert metal coating may comprise a thickness of at least approximately 0.1 μm, preferably at least approximately 0.4 μm, more preferred by at least approximately 0.8 μm. The inert metal coating may comprise a thickness ranging from approximately 0.08 μm to approximately 0.8 μm, preferably from 0.5 μm to approximately 0.6 μm, more preferred from approximately 0.3 μm to approximately 0.8 μm, more preferred from approximately 0.6 μm to approximately 1 μm, most preferred from 0.1 μm to 0.2 μm. Thereby, a reliable sealing of the base material of the inner flask and the lid allowed, such that the beverage cannot pass the inert metal coating and come into contact with the base material of the inner flask.

The base material of the inner flask, the outer flask and/or the lid may be made of steel, particularly stainless steel, V2A steel, V3A steel, V4A steel or V5A steel.

Preferably the base material of the inner flask may be manufactured by drawing, particularly the base material of the inner flask may be manufactured by drawing. During drawing the base material may be protected by a plastic layer and thus separated mechanically from the drawing tool. Thereby, a smooth surface of the base material of the inner flask may be achieved. The inert metal coating may be deposited by electro-galvanization.

The insulating layer may be a vacuum arranged between the inner flask and the outer flask.

The outer flask and the inner flask may be connected at the upper portion of the beverage vessel, such as by a welding. The beverage vessel may comprise a threat at the outer surface of the upper portion, particularly the outer flask. An outer thread is preferred. In this embodiment the beverage vessel may be a portable bottle.

The top portion of the beverage vessel that is touched by the lips of a user during drinking may be covered by the inert metal coating. Particularly, the outer top portion covered by the inert metal coating may extend at least approximately 5 mm, preferably at least approximately 8 mm, more preferred at least approximately 1 cm, most preferred at least approximately 2 cm from the top of the beverage vessel.

The inert metal coating prevents that the beverage assumes a metal taste or that the beverage vessel adopts the metal smell. The inert metal coating in the lid also avoids that beverage may adopt metal smell. The inert metal coating at the top portion of the beverage vessel avoids that the user of the beverage vessel experiences a metal smell during drinking from the beverage vessel.

Since the inner flask of the beverage vessel is not made of glass, the beverage vessel is light weight and shockproof. Further, inner surface of the inner flask is chemical inert due to the inert metal coating. In a preferred embodiment the vessel is a portable beverage bottle.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
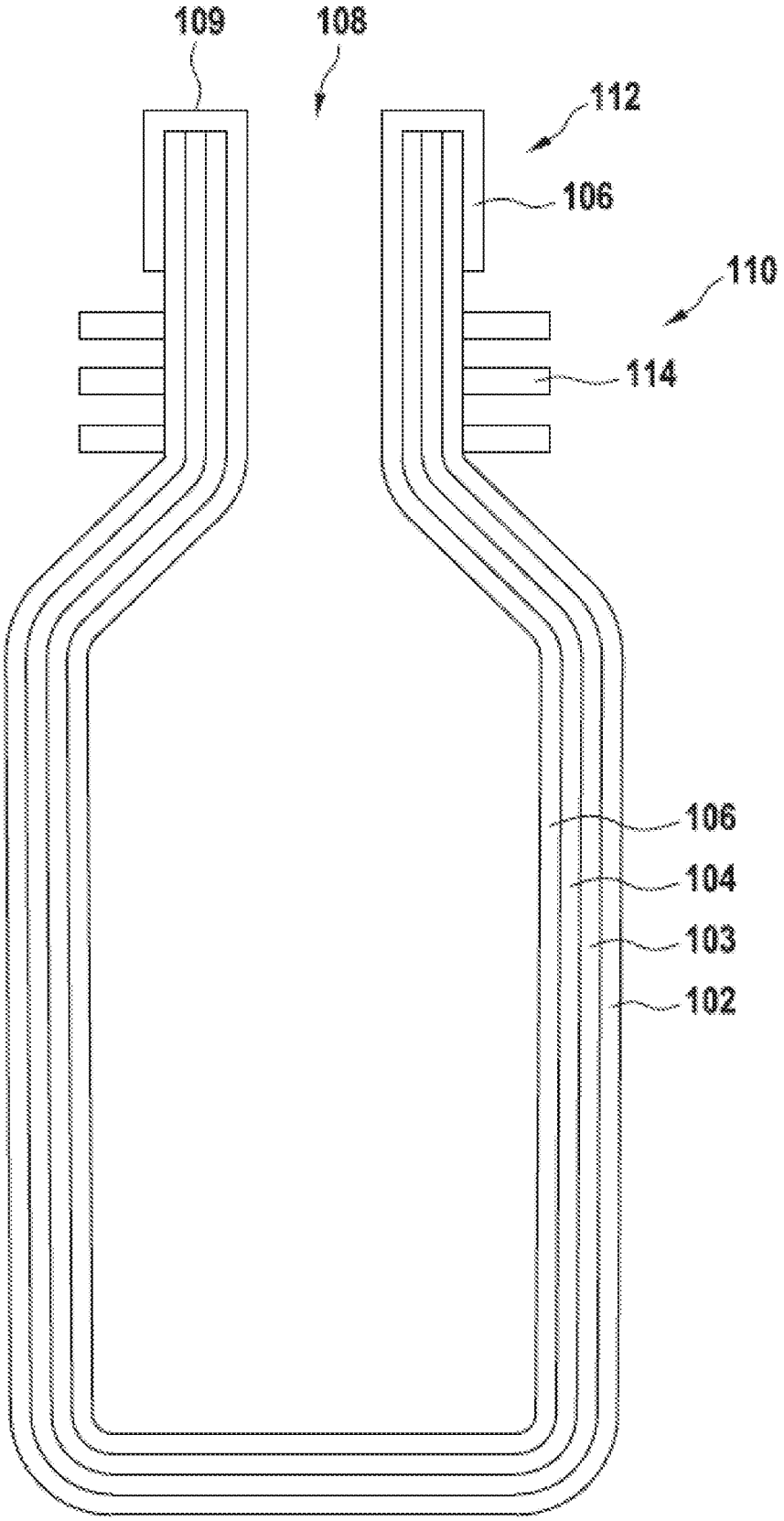
FIG. 1 shows a sectional view of the beverage vessel according to the present invention.

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on."

The drawings are merely schematic and provided for understanding the invention. The drawings are not drawn to scale. FIG. 1 shows a sectional view of a portable beverage bottle 100 for storing beverage having an inner flask 104 made of (not-inert) metal forming a base material. The inner flask 104 is adapted to store the beverage. The beverage bottle 100 further comprises an outer flask 102. A thermally insulating layer 103 is arranged between the inner flask 104 and the outer flask 102. The thermally insulating layer may be formed by a vacuum. An opening 108 for pouring beverage into the bottle or pouring beverage out of the bottle is arranged at the upper portion 110 of the inner and/or outer flask 102, 104. The inner flask is coated in its interior surface with an inert metal coating 106. The inert metal coating 106 has a thickness that prevents metal of the base material of the inner flask 106 to enter the beverage.

The inert metal coating 106 is preferably non-porous. A pore allows the beverage to contact the (not-inert) base material of the inner flask. The thickness of the inert metal coating is selected such that the surface of the inert metal coating is at least 95% non-porous, preferably 99% non-porous, more preferred 99.9% non-porous.

The thickness of the inert metal coating 106 is selected such that the surface of the inert metal coating comprises a pore density of less than 100 pores per $cm^2$, preferably less than 50 pores per $cm^2$, more preferred less than 10 pores per $cm^2$, most preferred less than 5 pores per $cm^2$.

The inert metal coating may comprise gold, platinum, palladium, ruthenium, silver and/or titanium. The inert metal coating may be made of an alloy comprising gold, platinum, palladium, ruthenium, silver and/or titanium.

The inert metal coating may comprise a thickness of at least approximately 0.1 μm to approximately 0.2 μm.

The base material of the inner flask 104 may be made of steel, such as stainless steel, V2A steel, V3A steel, V4A steel or V5A steel. The outer flask 102 may be made of steel, such as stainless steel.

The thermally insulating layer 103 may be vacuum. The outer flask 102 and the inner flask 104 may be connected at its upper portion 110, such as by welding. The beverage bottle 102 may comprise a thread 114 at the outer surface of the upper portion 110.

The inert metal coating 106 prevents not inert metal of the base material of the inner flask from entering the beverage. Thereby, a healthier beverage can be provided to a user. Further, metallic smell of the bottle or metallic taste of beverage is prevented.

The top portion 112 may be coated with the inert metal coating. Particularly, the top portion coated with the inert metal coating extends at least approximately 5 mm, preferably at least approximately 8 mm, more preferred at least approximately 1 cm, most preferred at least approximately 2 cm from the top of the beverage bottle 102. Since the lips of the user do not touch non-inert metal, such as steel, the user does not experience any metal taste on his lips.

Figure 2:
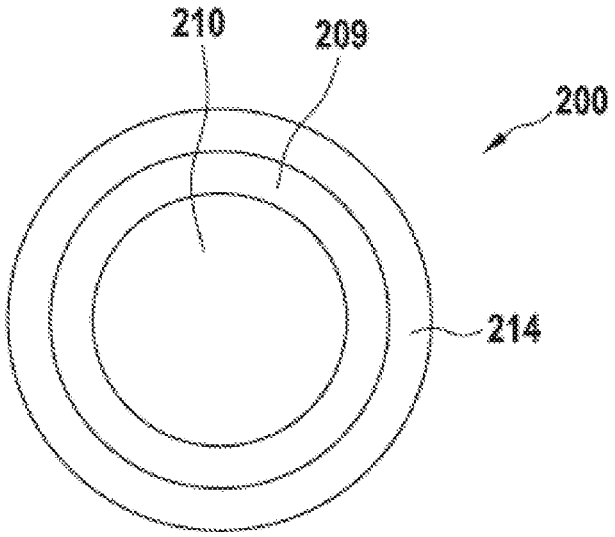
FIG. 2 shows a sectional top view of a lid according to the present invention.

FIG. 2 shows a top view of the inner portion of a lid 200. The lid 200 comprises an inner threat 214 adapted to engage with the outer threat 114 arranged at the upper portion 110 of the beverage bottle. The lid 200 comprises a seal 209, preferably a circular seal, fixed to the lid 200. In the portion 210 surrounded by the seal 209 an inert metal coating 210 is arranged. The lid 200 may be manufactured from (non-inert) metal, such as steel, V2A steel, V3A steel, V4A steel or V5A steel. The seal 209 may cooperate with a sealing surface 109 arranged around the opening 108 at the upper portion 110 of the beverage bottle 100. The seal 209 prevents beverage from flowing out of the bottle 100, if the lid 200 is screwed to the bottle 100 by the outer thread 114 formed on the bottle and the inner threat 214 formed on the lid 200.

Since beverage can flow to the portion 210 surrounded by the sealing 209, the portion 210 surrounded by the sealing 209 is covered by the inert metal coating 210, for avoiding contamination of the beverage in the beverage bottle 100 by metal ions, metal molecules, metal oxide molecules or the like.

The present invention achieves a lightweight and thermally insulating bottle that is not sensitive to shocks and avoids that beverage is contaminated by (not inert) metal.

The cost of the inert metal coating is comparably low, since the inert metal coating can be manufactured by galvanic methods.

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. § 112(f) unless the words "means for" or "step for" are explicitly used in the particular claim. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A beverage vessel for storing beverage, comprising:

an inner flask made of metal forming a base material, wherein in the inner flask is adapted to store the beverage;

an outer flask;

a thermally insulating layer arranged between the inner flask and the outer flask; and an opening for pouring the beverage into the beverage vessel or pouring the beverage out of the beverage vessel;

wherein the base material of the inner flask is coated in its interior surface with an inert metal coating, characterized in that the inertial metal coating comprises a hard gold layer having a hardness ranging between approximately 120 HV to approximately 360 HV.

2. The beverage vessel according to claim 1, wherein the inert metal coating has a thickness that prevents metal of the inner flask or metal of the lid to enter the beverage.

3. The beverage vessel according to claim 1, wherein the inert metal coating is at least approximately 95% non-porous, preferably approximately 99% non-porous, more preferred approximately 99.9% non-porous.

4. The beverage vessel according to claim 1, wherein the thickness of the inert metal coating is selected such that the surface of the inert metal coating comprises a pore density of less than 100 pores per cm'.

5. The beverage vessel according to claim 1, wherein the inert metal coating comprises a metal selected from a list of metals consisting of: gold; platinum; palladium; ruthenium; silver; and titanium.

6. The beverage vessel according to claim 1, wherein the inert metal coating comprises an alloy, wherein the alloy comprises hard gold, wherein the hard gold is an alloy comprising at least one of gold, cobalt and copper.

7. The beverage vessel according to claim 1, wherein the hardness of the hard gold layer is in a range between approximately 150 HV to 250 HV.

8. The beverage vessel according to claim 1, wherein the inert metal coating comprises a thickness in a range from approximately 0.08 μm to approximately 0.8 μm.

9. The beverage vessel according to claim 1, characterized by at least one of the following:

the inner flask is made of steel; and the outer flask is made of steel.

10. The beverage vessel according to claim 1, wherein the insulating layer is a vacuum disposed between the inner flask and the outer flask.

11. The beverage vessel according to claim 1, wherein the outer flask and the inner flask are connected at the upper portion of the beverage vessel.

12. The beverage vessel according to claim 1, wherein the beverage vessel comprises a thread at the outer surface at the upper portion.

13. The beverage vessel according to claim 1, wherein the outer top portion of the beverage vessel that is touched by lips of a user during drinking is covered by the inert metal coating.

14. The beverage vessel according to claim 1, wherein the thickness of the inert metal coating is selected such that the surface of the inert metal coating comprises a pore density of less than 10 pores per $cm^2$.

15. The beverage vessel according to claim 1, wherein the thickness of the inert metal coating is selected such that the surface of the inert metal coating comprises a pore density of less than 5 pores per $cm^2$.

16. The beverage vessel according to claim 1, wherein the inert metal coating has a thickness in a range from 0.15 μm to 0.6 μm.

17. The beverage vessel according to claim 1, wherein the inert metal coating comprises a thickness in a range from 0.3 μm to approximately 0.8 μm.

18. The beverage vessel according to claim 1, wherein the inert metal coating has a thickness in a range from 0.6 μm to 1 μm.

19. The beverage vessel according to claim 1, wherein the inert metal coating has a thickness in a range from 0.1 μm to 0.2 μm.

* * * * *